US005449099A

United States Patent [19]

Blanchard

[11] Patent Number: 5,449,099

[45] Date of Patent: Sep. 12, 1995

[54] HANGER WITH CHILD-PROOF SIZE-INDICATOR AND TOOL FOR REMOVING SAME

[75] Inventor: Russell O. Blanchard, Zeeland, Mich.

[73] Assignee: Batts, Inc., Zeeland, Mich.

[21] Appl. No.: 186,734

[22] Filed: Jan. 25, 1994

[51] Int. Cl.[6] ..... A47G 25/14

[52] U.S. Cl. ..... 223/85; 40/322

[58] Field of Search ..... 223/85, 88, 92, 95; 211/113; D6/315; 24/456; 29/426.6; 40/322

[56] References Cited

U.S. PATENT DOCUMENTS

| | | | |
|---|---|---|---|
| 1,256,426 | 2/1918 | Baltzley | 24/456 |
| 1,557,370 | 10/1925 | Lane | 24/456 |
| 4,323,378 | 4/1982 | Miljoen | 24/456 |
| 5,096,101 | 3/1992 | Norman et al. | 223/85 |
| 5,199,608 | 4/1993 | Zuckerman | 223/85 |

*Primary Examiner*—C. D. Crowder
*Assistant Examiner*—Bibhu Mohanty
*Attorney, Agent, or Firm*—Baker & McKenzie

[57] ABSTRACT

A combination garment hanger that is equipped for accommodating a child-proof size-indicating tab and a tool for removing said child-proof size-indicating tab from the said garment hanger is provided. The improved system enables an assembly-line worker to quickly and easily remove a child-proof tab from a garment hanger when a tab indicating the incorrect size is mistakenly applied to a garment hanger. The tool quickly and easily pries the tab off of the garment hanger so that a correct size-indicating tab may be applied to the hanger. The tab-holding section of the garment hanger is specially designed to accommodate the tool without compromising the child-proof qualities of the hanger and tab.

23 Claims, 6 Drawing Sheets

Fig. 28.
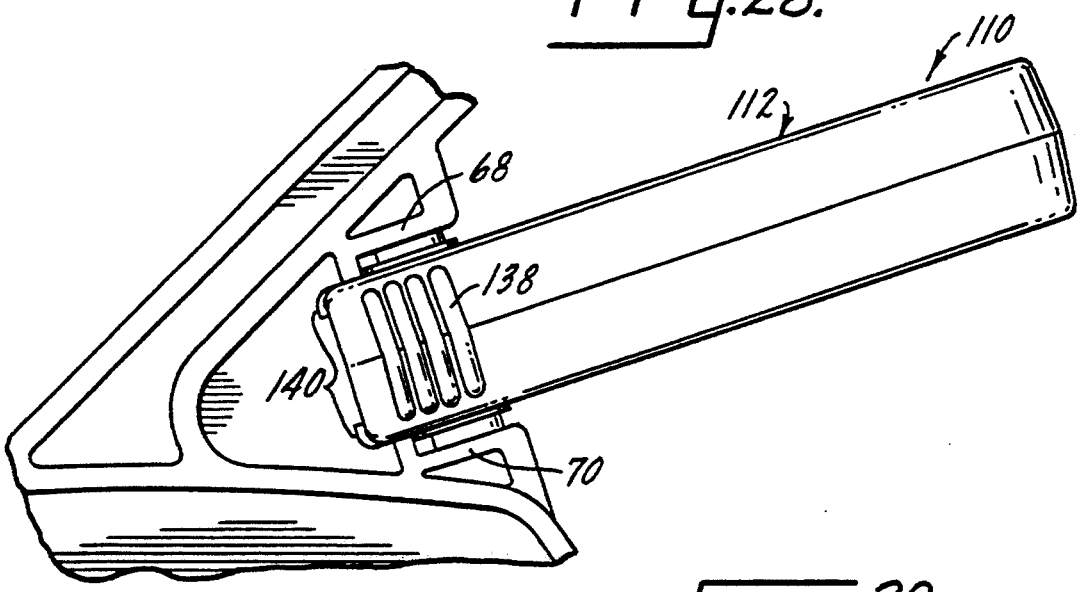
Fig. 29.
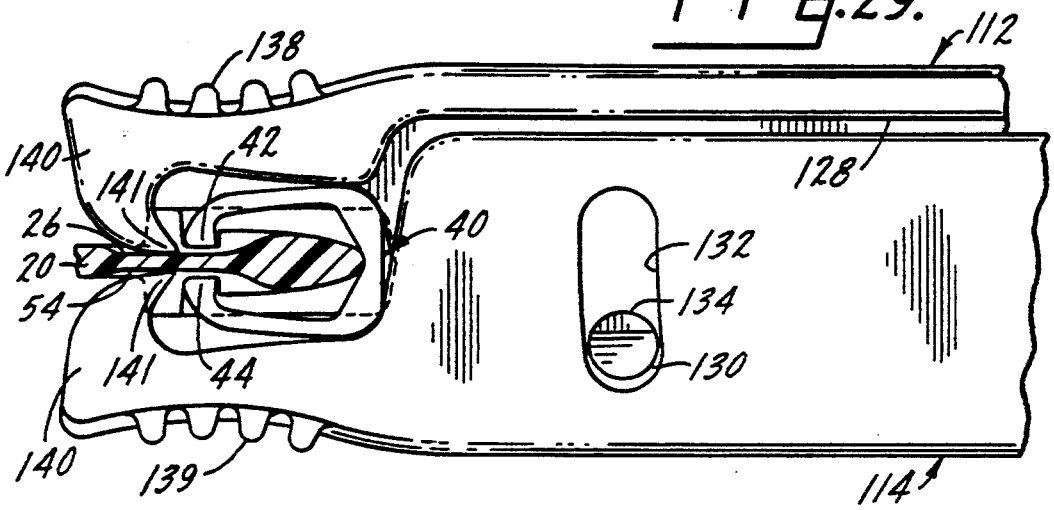
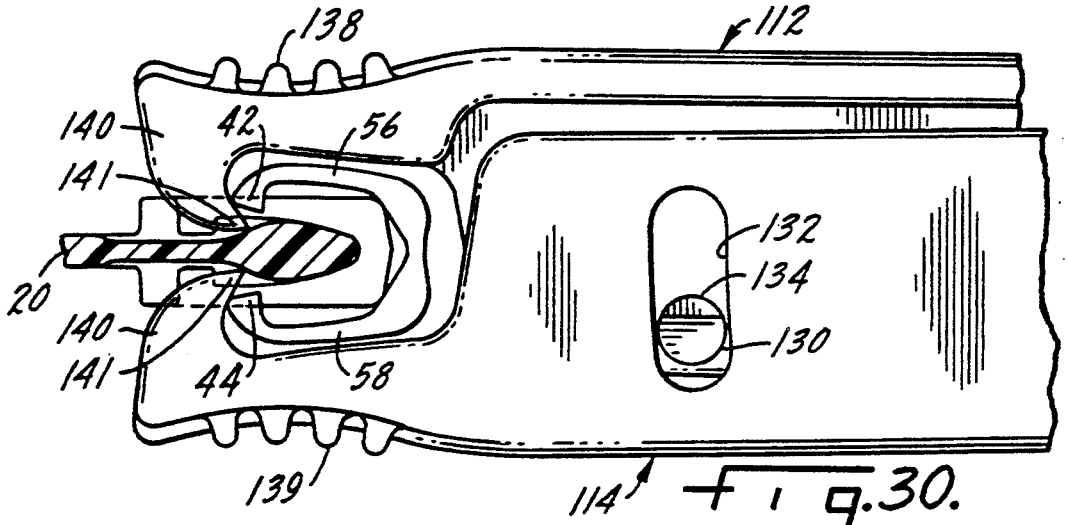
Fig. 30.

HANGER WITH CHILD-PROOF SIZE-INDICATOR AND TOOL FOR REMOVING SAME

This invention relates generally to an improved system for indicating the size of a garment suspended from a garment hanger. More specifically, this invention relates to an improved size-indicating tab and garment hanger equipped to accommodate size-indicating tabs whereby the size-indicating tab may be removed with specially designed tools in the event an incorrect size-indicating tab is mounted onto the garment hanger. Further, the combination garment hanger and tab is childproof whereby the size-indicating tabs are not removable by hand but only with the use of a tool whose use is beyond the capabilities of small children.

BACKGROUND OF THE INVENTION

The concept of a garment hanger that includes a label or tab mounted on the hanger that indicates the size of the garment is well-known and is commonly provided in what is known as a size-indicating tab. Further, modern safety standards require such size-indicating tabs be "child-proof" or irremovable once installed on a hanger. Otherwise, a small tab removed from the hanger may become lodged in a child's throat causing suffocation or serious injury. However, the child-proof size-indicating tabs currently available suffer from one common drawback: the tabs are not easily removed in the factory in the event that the wrong size tabs are installed by mistake.

Accordingly, there is a need for a system which includes a garment hanger and a size-indicating tab whereby the size-indicating tab may be removed without undue delay in the event the incorrect size-indicating tab is placed on the hanger. The manner in which the size-indicating tab can be removed must not be too easy; in other words, the size-indicating tab must still be "child-proof" or must be removable only with reasoning and finger dexterity available only to adolescents and adults. Otherwise, the tab would not satisfy the safety concerns of retailers and consumers.

From a cost-of-production standpoint, garment manufacturers need a size-indicating tab that is removable in the event the factory worker applies tabs indicating an incorrect size to a group of garment hangers or to a group of garment hangers carrying garments. An easy-to-use tool would be highly desirable in removing the wrong size-indicating tabs from the hangers and quickly replacing the wrong size-indicating tabs with correct tabs. Otherwise, the garment hanger including the wrong tab may have to be discarded, set aside or re-routed to another section of the facility in order to be used. If a fast and efficient system is provided, the wrong tab may be quickly removed, discarded and the correct tab be placed on the hanger and the only wasted materials would be the very small tabs that are removed from the garment hangers. A more important commodity—time, would be conserved.

Therefore, there is a need for an improved size-indicating tab in combination with a garment hanger whereby an incorrect tab may be quickly and easily removed by an assembly-line worker. The combination size-indicating tab and hanger must also retain the child-proof characteristics discussed above.

SUMMARY OF THE INVENTION

The present invention makes a significant contribution to the garment hanger art by providing an improved size-indicating system that is correctable. The size-indicating tab provided by the present invention may be easily removed from the garment hanger provided by the present invention by a simple-to-use tool and therefore an incorrect tab may be quickly and easily removed from a garment hanger in the factory setting before a correct tab is attached to the hanger. Further, the hanger/tab system provided by the present invention is safe for use in homes with small children.

The improved system provided by the present invention includes a garment hanger, a size-indicating tab and a means for removing the tab from the hanger. The garment hanger includes a garment support member connected to a hook or hang means. A tab-holding section is disposed at the connection between the garment support member and the hang means. The tab-holding section includes a wall which extends frontward along the shoulder of the garment support member towards the consumer. The wall terminates at a base portion of the tab-holding member. Each side of the wall includes a rib disposed between the base portion of the tab-holding member and the hanger. The space along each side of the wall between the rib and the base portion of the tab-holding member defines a receiving section for accommodating a curved end of a U-shaped tab.

The tab includes two opposing side members with the front end disposed therebetween. The opposing side members extend rearward and terminate at the inwardly curved ends that are accommodated in the receiving section when the tab is inserted over the tab-holding member and onto the hanger. The tab engages the tab-holding member so that the curved ends are in abutting engagement with the receiving sections behind the base portion of the tab-holding member and in front of the ribs. The base portion of the tab-holding member prevents the tab from being pulled frontward and off of the hanger and the protective ribs prevent small fingers from obtaining a purchase on the inwardly curved ends of the tab.

The means for removing the tab may be provided in a variety of forms, one of which is as follows. At least one channel disposed on the side of the wall extends through the rib, through the receiving section and through the base portion of the tab-holding member. A corresponding tab-removing tool includes one finger capable of extending through the channel and obtaining a purchase on one curved end of the size-indicating tab. The channel provides a ramp or passageway for the tool that leads to a curved end of the tab. The tab can be removed by pulling or pushing the tab-removing tool. The channel is sufficiently narrow so as to not enable the finger of a small child to obtain a purchase on the curved end of the tab. That is, the channel is not wide enough so as to interfere with the protective function provided by the rib.

In one embodiment, each wall of the tab-holding section of the garment hanger includes three channels although a range of one to four channels can be used. One tab-removing tool includes two opposing side palms that are hingedly connected together. Each palm includes three curved fingers disposed at the distal end thereof. The palms are opened, the tool is pushed over the tab-holding section of the garment hanger and then the tool is closed or the palms are pushed toward one and other thereby causing each curved finger to be pushed forward through the channel to obtain a purchase on the curved distal end of the size-indicating tab. The fingers, in effect, pry the curved ends of the tab away from the receiving sections of the tab-holding section and then the user may then simply pull the tool forward which will cause the tab to pull off of the tab-holding member.

As noted above, the configuration just-described may be substantially varied and still fall within the scope of the present invention. For example, only one channel is required in order to provide a passageway for a distal end of a tab-removing tool that will engage a curved end of the tab. Providing channels on both sides of the tab-holding section makes it easier to remove the tab and further providing a plurality of channels on each side of the tab-holding section makes it still easier to remove an incorrect size-indicating tab. In short, anywhere from one channel may be provided or one channel on each side or up to three or more channels on each side may be provided. Accordingly, the tab-removing tool should preferably include one finger or tab-engaging element per channel. The specific designs of the tab-removing tool disclosed in the drawings are convenient to use because as the two palms or two legs are pushed inwardly or toward one and other, the curved fingers which curve in a forward direction engage the channel and extend forward to the channel toward the curved ends of the tab. When sufficient inward pressure is applied to the tool by the user, the fingers will have extended forward through the portion of the channels that extend through the base portion of the tab-holding member and will have engaged the curved ends of the tab and have pried the curved ends of the tab away from the receiving sections and up and over the base portion of the flared tab-holding member.

The present invention also lends itself to an improved method of removing child-proof size-indicating tabs from specially equipped garment hangers. Once the assembly-line worker discovers that he or she has placed an incorrect size-indicating tab on a garment hanger, the worker then opens the tab-removing tool and places it over the tab and aligns the curved fingers disposed at the distal ends of the tab-removing tool with the channels provided in the garment hanger. The tool is then closed or pressed inward so that the curved fingers extend forward through the channels and into the portion of the channels disposed in the base portion of the tab-holding member. The engagement of the curved fingers with the curved ends of the tab cause the tab to be pried away from the receiving sections of the tab-holding section and forward over the base portion of the tab-holding member. The tool is then pulled forward. The forward movement of the tool causes the fingers to slide forward through the portions of the channels disposed in the base portion of the tab-holding member and this action also causes the fingers to pull the tab completely off of the tab-holding member.

It is therefore an object of the present invention to provide an improved garment hanger that provides a means for removing child-proof size-indicating tabs therefrom.

Another object of the present invention is to provide a tool for removing child-proof size-indicating tabs from garment hangers.

Yet another object of the present invention to provide an improved method for removing an incorrect size-indicating tab from a garment hanger.

BRIEF DESCRIPTION OF THE DRAWINGS

This invention is illustrated more or less diagrammatically in the accompanying drawings, wherein:

FIG. 28 is an enlarged, partial front plan view of the tab-removing tool of FIG. 20 as inserted over the size-indicating tab and tab-holding section shown in FIG. 8;

FIG. 29 is a sectional view of the tab-removing tool, tab and garment hanger shown in FIG. 28; and FIG. 30 is the partial sectional view shown in FIG. 29 with the tab-removing tool pushed inward so that the curved fingers or claws have engaged the curved ends of the size-indicating tab thereby promoting removal of the tab from the tab-holding section of the garment hanger.

Figure 1:
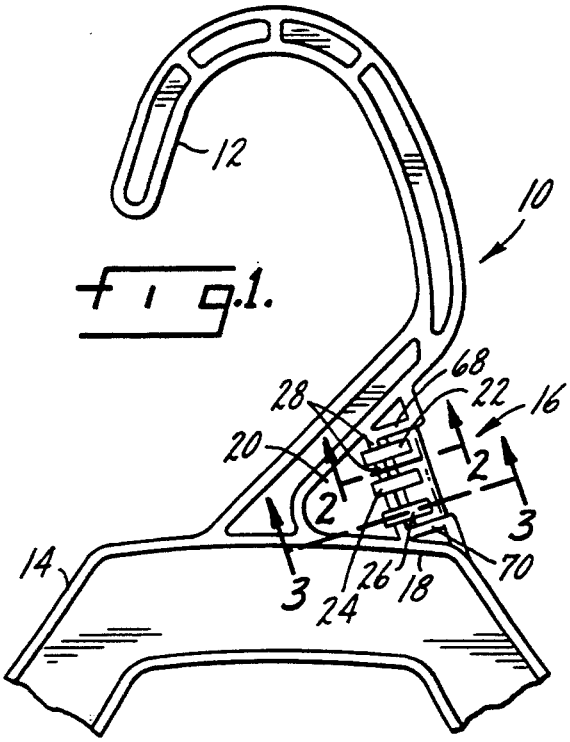
FIG. 1 is a partial front elevational view of a garment hanger, particularly illustrating the tab-holding section of the garment hanger.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE INVENTION

Like reference numerals will be used to refer to like or similar parts from Figure to Figure in the following description of the drawings.

As seen in FIG. 1, the garment hanger 10 includes a hook or hang means 12 which is mounted to a garment support member 14. The hook 12 as shown in FIG. 1 is intended to engage a rod-type clothes rack as found in most homes. However, the hang means 12 may be reconfigured to accommodate the different types of clothes racks found in hotels which are designed to deter theft of the garment hangers or other, more modern clothes racks.

The tab-holding section, indicated generally at 16 is disposed between the hook 12 and the shoulder 18. A wall 20 extends frontward from the hook 12/shoulder 18 junction. As best seen in FIG. 1, the embodiment illustrated in the figures includes three channels 22, 24, 26 which provide access passageways for the fingers of the tab-removing tools which will be discussed in detail later. The channels 22, 24, 26 are considered to be interruptions or slots in the rib indicated generally at 28 and the tab-holding member indicated at 34. The rib 28 could also be considered to be a series of protrusions with the wall 20 or flattened areas 22, 24, 26 disposed therebetween. The remaining elements of the tab-holding section 16 are more easily described in FIGS. 2 and 3.

Figure 2:
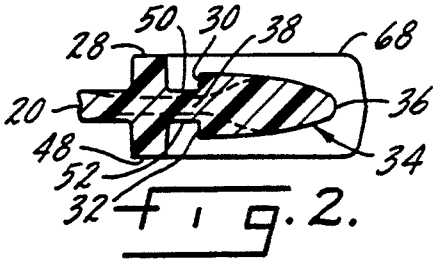
FIG. 2 is sectional view taken substantially along line 2—2 of FIG. 1.

Turning to FIG. 2, the wall 20 extends frontward and terminates at the flared edges 30, 32 of the base portion of the tab-holding member 34. In the embodiment shown in FIG. 2, the tab-holding member 34 is bullet-shaped; however, other configurations will be readily ascertainable by those skilled in the art. For example, the primary requirements of the tab-holding member 34 are the narrow or tapered front end 36 and the flared base portion 38 which provides the edges 30, 32 which act to hold the tab 40 (see FIG. 8) in place. An alternative configuration could be an arrow-shaped tab-holding member 34 with a narrow front end and flared base portion or a more triangular-shaped tab-holding member 34. Further, a triangular-shaped base portion would also work because it would have a narrow front end for sliding the tab onto the tab-holding member and a flared base portion for retaining the curved ends 42, 44 (see FIG. 8) in place.

Figure 8:
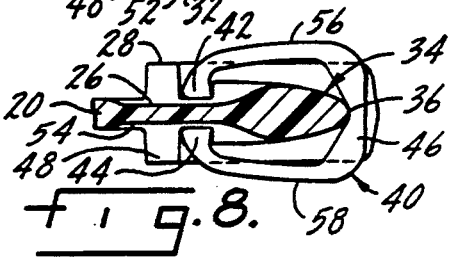
FIG. 8 is a sectional view taken substantially along line 8—8 of FIG. 7.
Figure 16:
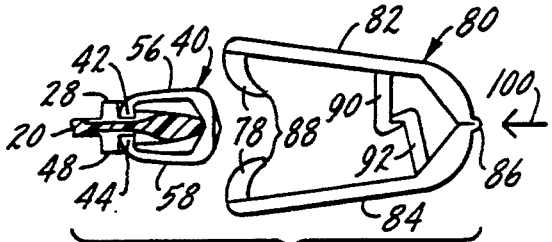
FIG. 16 is a bottom view of the tab-removing tool shown in FIG. 15 as it is being inserted over the tab and tab-holding section shown in FIG. 8.
Figure 17:
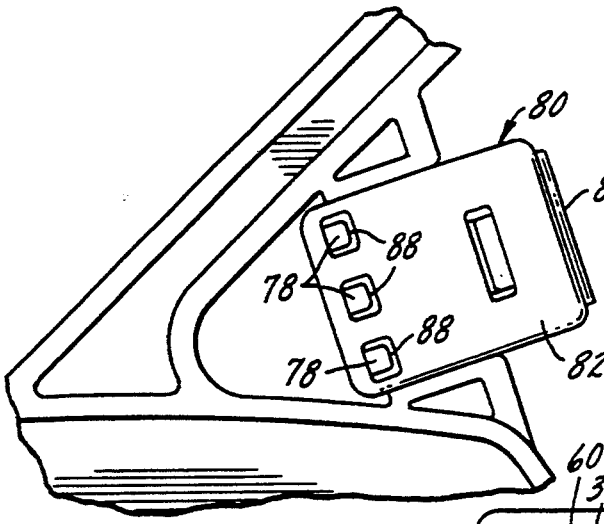
FIG. 17 is an enlarged, partial front plan view of the tab-removing tool of FIG. 9 as inserted over the size-indicating tab and tab-holding section shown in FIG. 8.

Returning to FIG. 2, the wall 20 carries two outwardly protruding ribs 28, 48. As seen in FIGS. 8 and 16, the ribs 28, 48 provide a guard for the curved ends 42, 44 of the tab 40 thereby precluding the small fingers of a child from obtaining a purchase on the curved ends 42, 44 of the tab 40 and thereby ensuring that the tab 40 is "child proof". Returning to FIG. 2, the wall 20 defines two receiving sections 50, 52. Receiving section 50 is disposed between the rib 28 and the edge 30 of the flared base portion 38. The receiving section 52 is disposed between the rib 48 and the edge 32 of the flared base portion 38. The receiving sections 50, 52 accommodate the curved ends 42, 44 as illustrated in FIG. 8.

Figure 3:
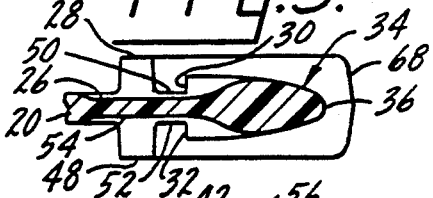
FIG. 3 is a sectional view taken substantially along line 3—3 of FIG. 1.

Turning to FIGS. 2 and 3 with further reference back to FIG. 1, a channel 54 corresponding to the channel 26 is also included on the opposing side of the wall 20. The channel 26 begins rearward of the rib 28 and extends through the rib 28 past the edge 30 of the base portion 38. The channel 26 provides an effective passageway for a tab-removing tool 80 (see FIGS. 9–19) the extend past the protective rib 28 forward to engage to curved end 42 of the tab 40 as seen in FIG. 8. Similarly, the channel 54 provides a passageway for a tab-removing tool 80 to extend past the protective rib 48 forward to engage the curved end 44 of the tab 40. A variety of tab-removing tools will be readily apparent to those skilled in the art with two of the possible embodiments illustrated below.

Figure 4:
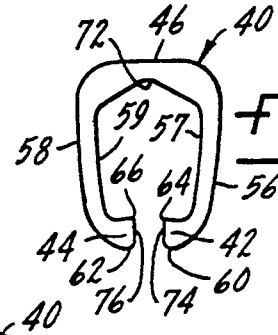
FIG. 4 is a top plan view of a size-indicating tab made in accordance with the present invention.

Turning to FIGS. 4 and 8, the tab 40 includes a front end 46 disposed between the opposing side members 56, 58. The opposing side members 56, 58 terminate in the inwardly curved ends 42, 44 which are received in the receiving sections 50, 52 (see FIGS. 2 and 3). The inside surfaces 57, 59 of the opposing side members 56, 58 respectively are free of any protrusions or projections intended to secure the tabs 40 to the tab-holder 34. Each inwardly curved end 42, 44 includes a rounded portion 60, 62 respectively and square inner edges 64, 66 respectively. The square inner edges 64, 66 engage the edges 30, 32 of the flared base portion 38 and help maintain the position of the tab 40 on the tab-holding member 34. The rounded portions 60, 62 make it easy for a tab-removing tool to obtain a purchase on the rounded portions 60, 62 during the tab removing operation. The protective ribs 28, 48 prevent a child's finger or finger nail from obtaining a purchase on either rounded portions 60, 62 of the curved ends 42, 44 respectively. The upper rib 68 and lower rib 70 (see FIG. 1) also prevent a child's finger from obtaining a purchase on the tab 40.

The slot or groove 72 accommodates the front end 36 of the tab-holding member 34. The flat inner surfaces 74, 76 of the curved ends 42, 44 are sufficiently wide enough so as to substantially span the surface area of the receiving sections 50, 52 to provide a relatively snug fit, and the overall fit of the tab 40 over the tab-holding member 34, while not tight, is relatively rocking free so as to further preclude removal of the tab 40 by a child.

Figure 5:
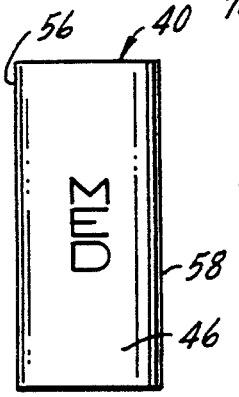
FIG. 5 is a front plan view of the size-indicating tab shown in FIG. 4.
Figure 6:
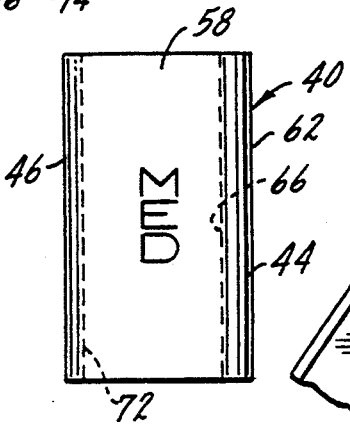
FIG. 6 is a side view of the size-indicating tab shown in FIG. 4.
Figure 7:
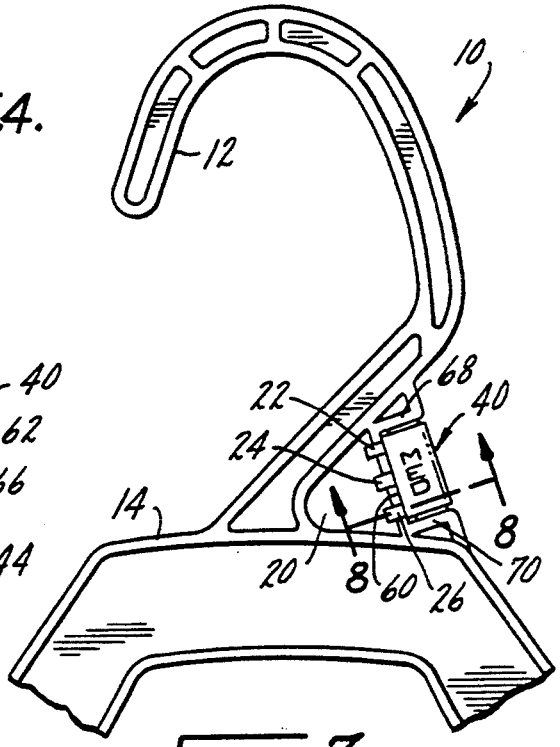
FIG. 7 is a partial front elevational view of the garment hanger shown in FIG. 1 with the size-indicating tab attached thereto.

Of course, a primary functional purpose of the size-indicating tab 40 is to prominently display the size of the garment as shown by the front end 46 as seen in FIG. 5 and the side 56 as seen in FIG. 6. FIG. 7 is an illustration of the tab 40 mounted over a tab-holding member 34 (not shown in FIG. 7) of a tab-holding section 16. The channels 22, 24, 26 are narrow enough so as to preclude a small finger from extending upward through them in order to obtain a purchase on the rounded edge 62 of the tab 40. However, the channels 22, 24, 26 are wide enough to accommodate the fingers 78 of the tab-removing tool 80 shown in FIG. 9.

Figure 9:
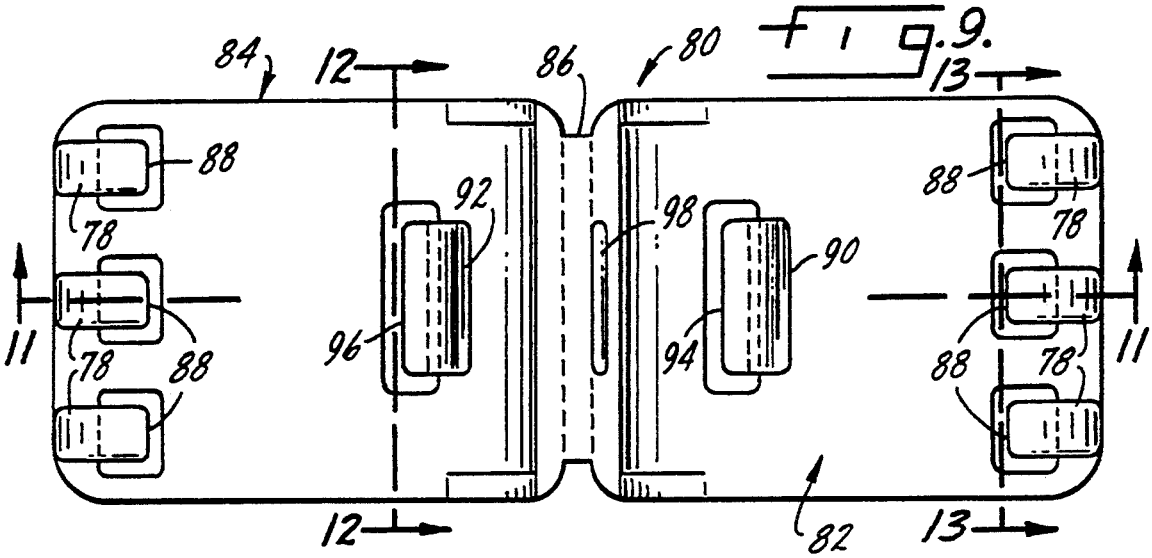
FIG. 9 is a plan view of a tab-removing tool made in accordance with the present invention.

Turning now to FIG. 9, a tab-removing tool 80 includes two opposing palms or members 82, 84 that are hingedly connected together via a living or mechanical hinge shown at 86. Because each side of the wall 20 of the tab-holding section 16 of the garment hanger 10 includes three channels like the channels 22, 24, 26 shown in FIG. 1, each distal end of the members 82, 84 include three fingers, all of which are shown at 78.

Figure 10:
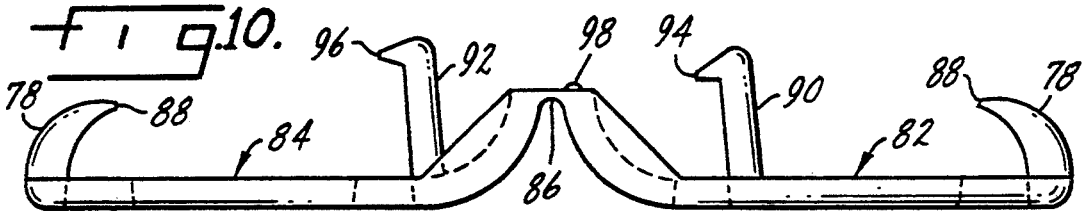
FIG. 10 is a side view of the tab-removing tool shown in FIG. 9.
Figure 11:
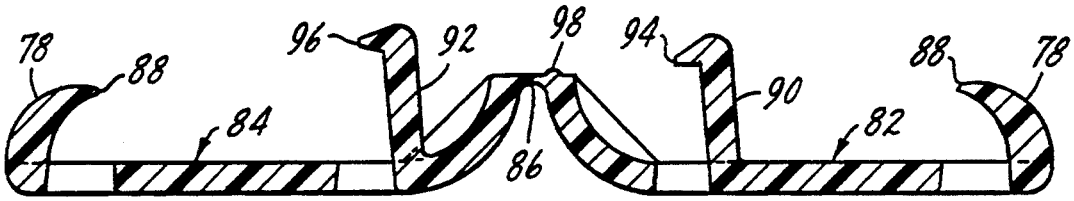
FIG. 11 is a sectional view taken substantially along line 11—11 of FIG. 9.
Figure 14:
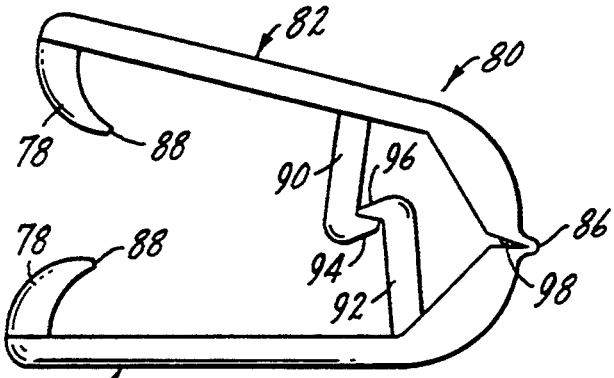
FIG. 14 is a top view of the tab-removing tool shown in FIG. 9, particularly illustrating the tab-removing tool in an open position ready to be mounted over a size-indicating tab to be removed.
Figure 12:
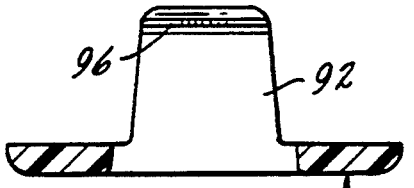
FIG. 12 is a sectional view taken substantially along line 12—12 of FIG. 9.
Figure 13:
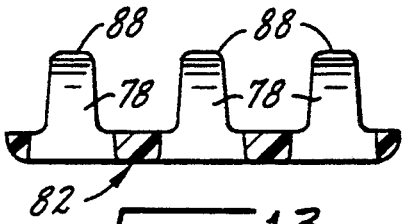
FIG. 13 is a sectional view taken substantially along line 13—13 of FIG. 9.

Turning to FIG. 10, the shape of the fingers 78 is illustrated. Each finger curves inwardly and forwardly, using FIG. 14 as a reference, and terminates at a pointed distal end 88. The end 88 obtains the purchase on the rounded portion 60 or 62 of the curved end 42 or 44 of the tab 40. Each palm or member 82, 84 features an upwardly protruding wall 90, 92 respectively and each wall 90, 92 includes a dog 94, 96 respectively. The dogs engage each other to restrict opening movement of the tab-removing tool as shown in FIG. 14. The inside portion of the palm 82 also includes a rib 98 which biases the palms 82, 84 outward to the open position shown in FIG. 14.

Figure 15:
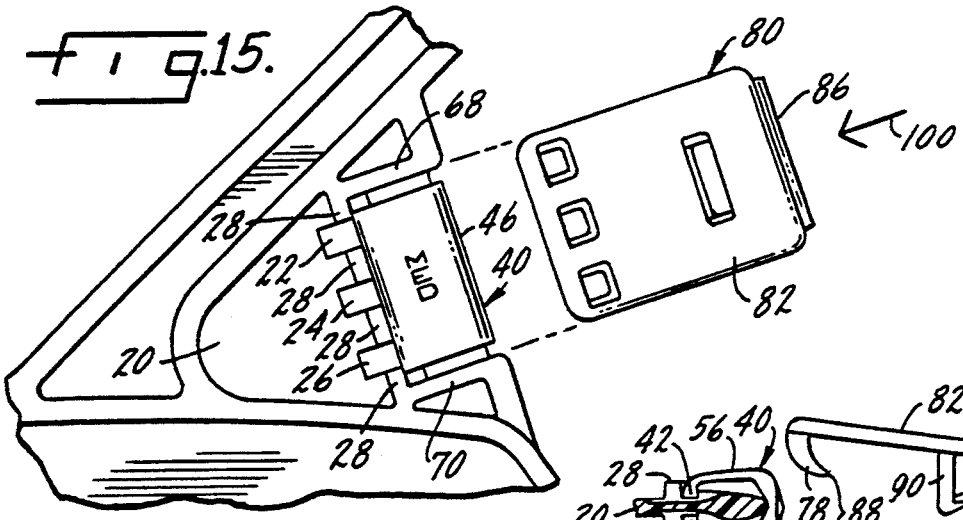
FIG. 15 is an enlarged partial front elevational view of the garment hanger as shown in FIG. 7, particularly illustrating the alignment of the tab-removing tool shown in FIG. 9 prior to the mounting of the tool over the size-indicating tab.

Turning to FIGS. 15 through 19, the operation of the tab-removing tool 80 and the method of removing a tab 40 from the garment hanger 10 is illustrated. Referring first to FIG. 15, the tab-removing tool 80 is aligned so the hinge 86 is parallel with the front end 46 of the tab 40. Because the rib 98 biases the palms 82, 84 toward an open position (see FIG. 14), the user simply pushes the tab-removing tool 80 in the direction of the arrow 100 toward the tab 40. The biased open position of the tab-removing tool 80 first shown in FIG. 14 is further illustrated in FIG. 16. From FIG. 16, the forwardly curved shape of the fingers 78 provides for a smooth engagement between the fingers 78 and the opposing side members 56, 58 of the tab 40. The heights of the walls 90, 92 are adjusted so that the fingers 78 slide easily over the tab 40 to assume the position shown in FIG. 17.

Figure 18:
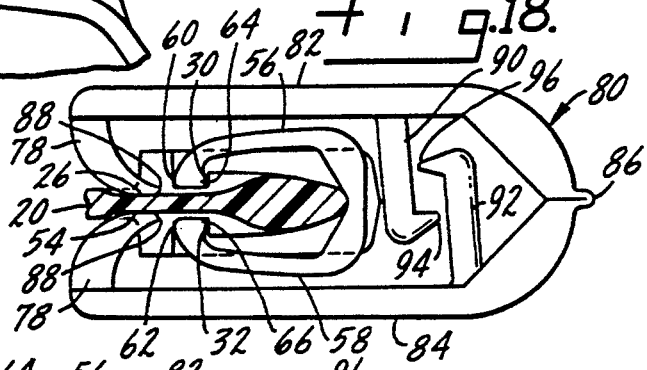
FIG. 18 is a partial sectional view of the tab-removing tool, tab and garment hanger shown in FIG. 17.
Figure 19:
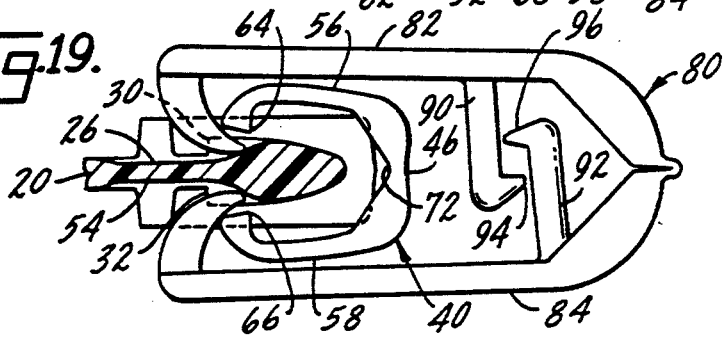
FIG. 19 is the partial sectional view shown in FIG. 18 with the tab-removing tool pushed inward so that the curved fingers have engaged the curved ends of the size-indicating tab thereby promoting removal of the tab from the tab-holding section of the garment hanger.
Figure 21:
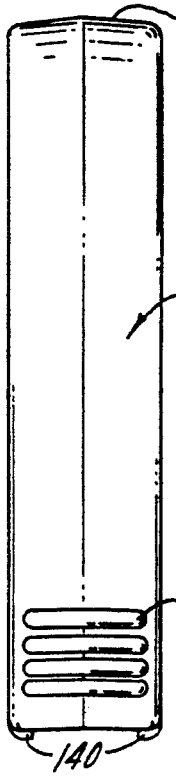
FIG. 21 is a top plan view of the tab-removing tool shown in FIG. 20.

Turning now to FIG. 18, once the tab-removing tool 80 is disposed over the tab-holding section 16, the fingers 78 are in alignment with channels such as 26, 54 (see also FIG. 3) and to engage the distal ends 88 of the fingers with the rounded portions 60, 62 of the tab 40, the user presses the palms 82, 84 toward one another thereby causing the fingers 78 to extend forward through the channels 26, 54. As seen in FIG. 19, the distal ends 88 of the fingers 78 have slid under the rounded portions 60, 62 of the tab 40 and opposing side members 56, 58 of the tab 40 have been pried apart thereby enabling the tab 40 to be removed from the tab-holding member 34. As illustrated in FIG. 19, the tab-removing tool is simply pulled forward in a direction opposite to that shown in the arrow 100 and the tab-removing tool 80 and tab 40 are removed from the hanger 10. As seen in FIG. 19, as the pointed ends 88 of the fingers 78 slide under the curved ends 60, 62 of the tab 40, the square edges 64, 66 are lifted up and over the edges or steps 30, 32 of the flared base portion 38 of the tab-holding member 34.

As illustrated in FIGS. 15 through 19, the tab 40 may be removed via the following method. The tab-removing tool 80 is aligned with the tab 40 and pushed forward over the tab 40 and over the tab-holding section 16. The two side palms 82, 84 are then squeezed together under moderate hand pressure which causes the fingers 78 to proceed through the corresponding channels 22, 24 or 26 toward the rounded portions 60, 62 of the inwardly curved ends 42, 44 of the tab 40. The distal pointed ends 88 of the fingers 78 slide underneath the rounded portions 60, 62 of the curved ends 42, 44 and pry the opposing side members 56,58 apart. This action causes the square edges 64, 66 of the opposing side members to be lifted up over the steps or ledges 30, 32 of the flared based portion 38 of the tab-holding member 34. Once the square edges 64, 66 are lifted above the flared base portion 38 of the tab-holding member 34, the tab-removing tool and tab 40 may be pulled outward in a forward direction toward the user and off of the garment hanger 10.

As noted above, the embodiment shown in FIGS. 1 through 19 disclose the use of three channels per side. Embodiments featuring the use of only two channels or one channel per side may be employed and further only one channel overall need be provided in order to remove the tab 40 from the garment hanger 10. It has been found that the use of three channels 22, 24, 26 per side of the tab-holding section 16 and three fingers 78 per opposing palm member 82, 84 of the tab-removing tool 80 facilitates the removal of the tabs 40 from the hanger 10. However, embodiments with fewer channels would still fall within the scope of the present invention.

Figure 20:
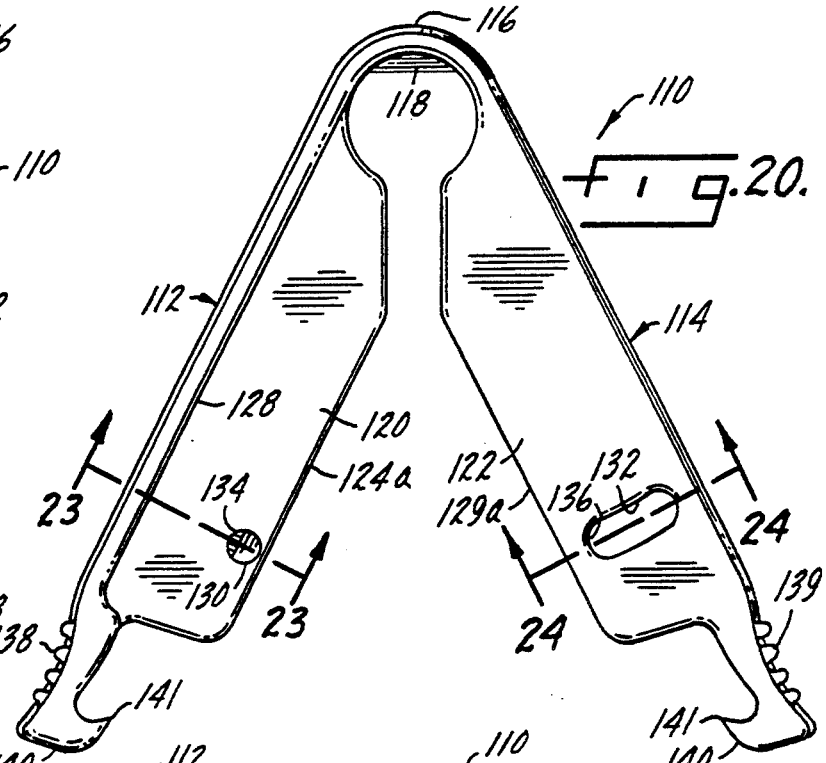
FIG. 20 is an alternative side plan view of a tab-removing tool made in accordance with the present invention.

An alternative tab-removing tool 110 is illustrated in FIG. 20. In contrast to the opposing palms or members 82, 84 of the tab-removing tool 80 shown in FIG. 9, the tool 110 includes two hingedly connected members 112, 114 that may be more appropriately referred to as legs 112, 114. The legs 112, 114 are connected at a hinge section 116. The legs 112, 114 are biased in the outward direction as shown in FIG. 20 by the crossbar 118.

Figure 22:
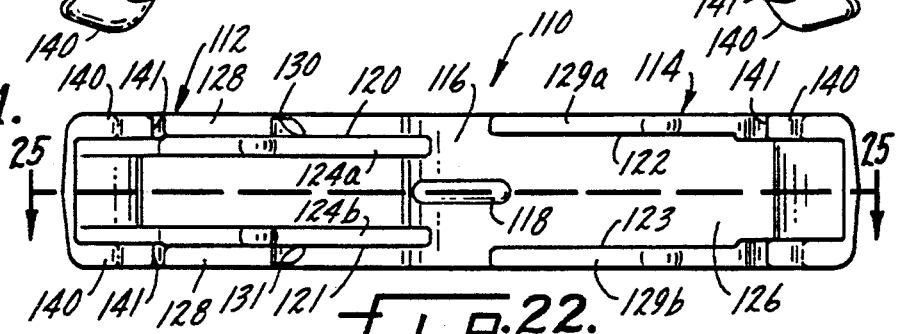
FIG. 22 is bottom plan view of the tab-removing tool shown in FIG. 20 in a fully opened position.
Figure 23:
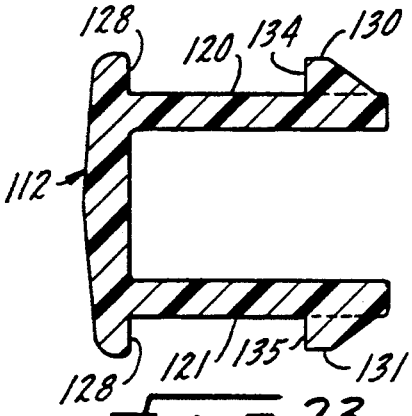
FIG. 23 is a sectional view taken substantially along line 23—23 of FIG. 20.
Figure 24:
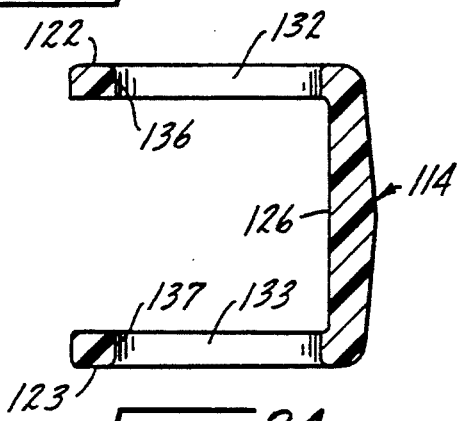
FIG. 24 is a sectional view taken substantially along line 24—24 of FIG. 20.
Figure 25:
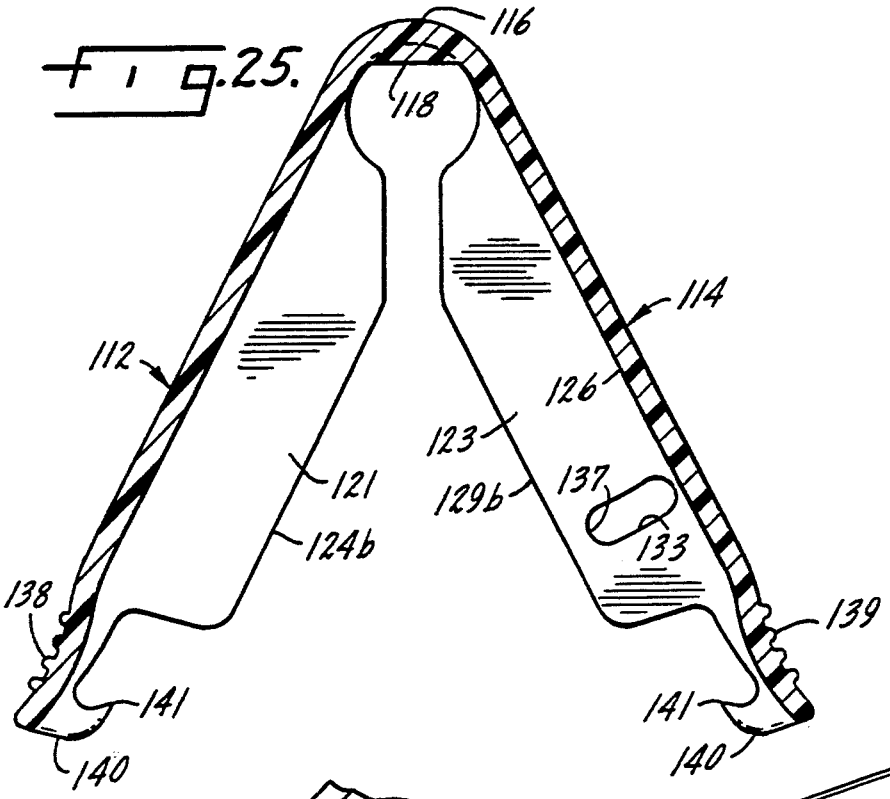
FIG. 25 is a sectional view taken substantially along line 25—25 of FIG. 22.

Referring to FIGS. 20 and 22 together, each leg 112, 114 includes two abutment members. Leg 112 includes abutment members 120, 121; leg 114 includes abutment members 122, 123. The abutment members 120, 121, 122, 123 act to limit inward movement of the legs 112, 114 toward one another. Specifically, the inside surfaces **124*a*, 124*b* of the abutment members 120, 121 respectively engage the inside surface 126 of the leg 114 when the legs 112, 114 of the tool 110 are pressed fully inward toward one another. Contemporaneously, the inside surfaces 129*a*, 129*b* of the abutment members 122, 123 respectively engage the inside-facing surface 128 of the leg 112 when the legs 112, 114 of the tool 110** are compressed fully inward toward one another.

Figure 27:
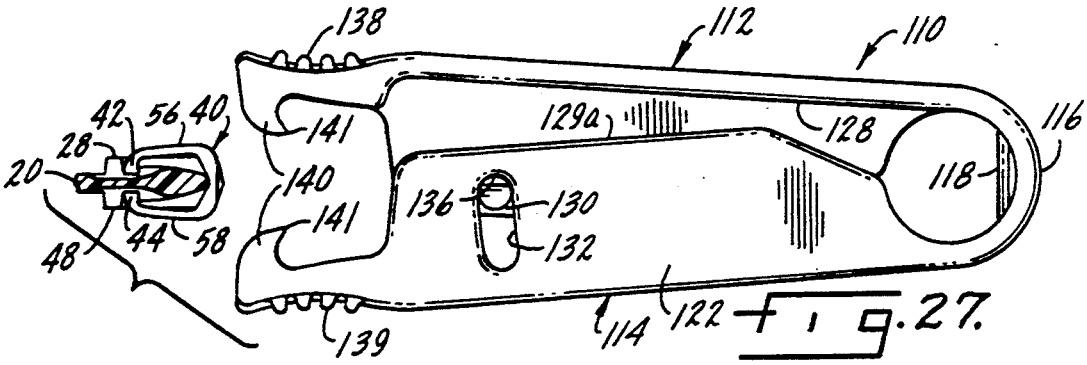
FIG. 27 is a bottom view of the tab-removing tool shown in FIG. 26 as it is being inserted over the tab and tab-holding section shown in FIG. 8.

Referring collectively to FIGS. 20–23, the abutment members 120, 121 include dogs 130, 131 which are accommodated in the slots 132, 133 disposed in the abutment members 122, 123 respectively. Because of the spring bias affect of the cross bar 118 of the hinge 116 (see FIG. 20), the outside surfaces 134, 135 of the dogs 130, 131 respectively engage the inner ends 136, 137 of the slots 132, 133 respectively when the tool 110 is in a relaxed state as illustrated in FIG. 27. The ridges shown at 138, 139 provide finger grips at the distal ends of the legs 112, 114 respectively. In a configuration which is similar to the one shown with respect to the tab-removing tool 80, the fingers illustrated generally at 140 curve inwardly and terminate at a sharp edge indicated generally at 141. The sharp edge 141, similar to the sharp edge 88 illustrated with respect to tool 80 above, obtains a purchase on the inwardly curved ends 42, 44 of the size-indicating tab 40.

Figure 26:
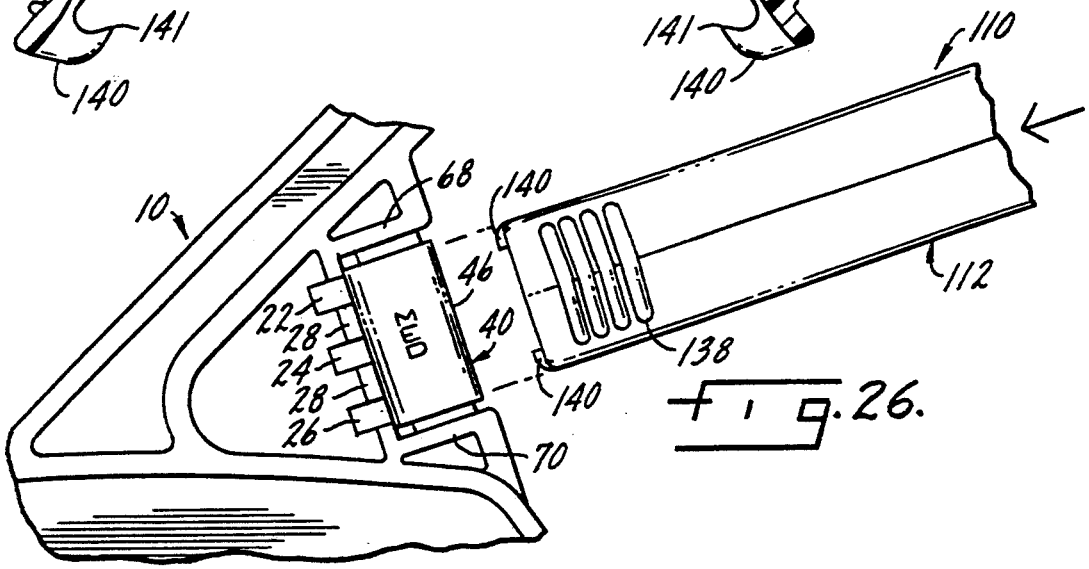
FIG. 26 is an enlarged partial front elevational view of the garment hanger as shown in FIG. 7, particularly illustrating the alignment of the tab-removing tool shown in FIG. 20 prior to the mounting of the tool over the size-indicating tab.

Use of the tool 110 is illustrated in FIGS. 25–30 and is analogous to the use of the tool 80 as illustrated in Figures 15–19 above. Briefly, the tool 110 is aligned so the hinge 116 is approximately parallel to the front wall 46 of the size-indicating tab 40 as shown in FIG. 26. The tool 110 is in the open position as shown in FIG. 27 with the dog 130 engaging the inside end 136 of the slot 132. The tool is then moved forward over and around the tab 40 as shown in FIG. 28. As the two legs 112,114 are squeezed inward toward one another as shown in FIG. 29, the sharp edges or ends 141 of the fingers 140 proceed upward through the channels 26 and 54 toward the inwardly curved ends 42, 44 respectively of the tab 40. As shown in FIG. 30, as the legs 112, 114 are squeezed further inwardly toward one another by the operator, the sharp edges 141 of the fingers 140 obtain a purchase on the inwardly curved ends 42, 44 and pry the opposing side members 56, 58 apart. Finally, the tool 110 is pulled outward or to the right as shown in FIG. 30 and the tab 140 is removed from the tab-holding section 16 of the hanger 10. The primary difference between the tab-removing tool 110 and the tab-removing tool 80 being that the tab-removing tool 110 includes two fingers per leg or member 112, 114 and the tab-removing tool 80 includes three fingers per palm or member 82, 84. The tab-removing tool 80 includes one finger 78 per channel such as 22, 24, 26 and the tab-removing tool 110 includes fingers for the two outside channels such as 22, 26.

Further, the tool illustrated in FIGS. 9–19 and the tool illustrated in FIGS. 20–30 are but two of several designs available for the tab-removing tool 80. For example, a tab-removing tool could be designed that could be applied from the backside of the tab-holding section 16 of the garment hanger, or through the open end of the hook 12. The hinge 86 may be replaced by other pivotal attachment means. Prongs could be provided for passing forward through the channels to dislodge the curved ends 42, 44 from the receiving sections 50, 52. Another option would be to provide a hand tool with a finger or narrow shaft for extending through one of the channels to pry the tab 40 off of the tab-holding section 16. Other alternative designs will be apparently to those skilled in the art.

Although only two preferred embodiments of the present invention have been illustrated and described, it will at once be apparent to those skilled in the art that variations may be made within the spirit and scope of the present invention. Accordingly, it is intended that the scope of the present invention be limited solely by the scope of the hereafter appended claims and not by any specific wording in the foregoing description.

I claim:

1. A system for labelling garment hangers to indicate the size of garments hung on the garment hangers and for correcting mislabeled garment hangers, the system comprising:

a garment hanger;

a size-indicating tab; and means for removing the tab from the hanger;

the garment hanger comprising a tab-holding section extending from the garment hanger, the tab-holding section comprising a wall having a two opposing sides, the wall extending frontward toward the consumer and terminating at a tab-holding member, said tab holding member having a base portion, rib means carried by the wall and located rearwardly from the base portion of the tab-holding member, said rib means and tab holder defining two receiving sections, one receiving section disposed between each rib means and the base portion of the tab-holding member on each side of the wall;

the tab comprising opposing side members extending rearward and terminating at inwardly extending ends, the inwardly extending ends being in abutting engagement with the receiving sections, the tab-holding member being disposed between the opposing side members and rearward of the front end of the tab, the inwardly extending ends of the opposing side members being resiliently biased inward toward each other: and the means for removing the tab from the hanger comprises at least one channel formed in one side of the wall and extending through the rib means on one side of the wall and into one receiving section, the inwardly extending end of the tab, when in contact with the receiving section, being spaced away from the bottom of the channel, and a tab removal tool including at least one finger disposed at a distal end thereof, the finger being shaped to extend into the space between the receiving section and the bottom of the channel to obtain a purchase under the end of the tab resting on the receiving section.

2. The system of claim 1, wherein both sides of the wall include a channel extending frontward and disposed in one side of the wall and extending through one rib, through one receiving section and through the base portion of the tab-holding member.

3. The system of claim 2, wherein the tab-removal tool includes two opposing side members pivotally connected together, each member including a finger for extending through a channel.

4. The system of claim 1, wherein both sides of the wall include two channels disposed parallel to each other.

5. The system of claim 4, wherein the tab-removal tool includes two opposing side members pivotally connected together, each member including two fingers for extending through the two channels disposed on each side of the wall.

6. The system of claim 1, wherein both sides of the wall include three channels disposed parallel to each other.

7. The system of claim 6, wherein the tab-removal tool includes two opposing side members pivotally connected together, each member including three fingers for extending through the three channels disposed on each side of the wall.

8. The system of claim 3, wherein each finger is curved inwardly and includes a sharp, tapered distal end to assume a claw-like configuration, the distal end of each finger obtaining a purchase on the corresponding curved end of the tab.

9. The system of claim 8, wherein the tab-holding member includes a narrow front end and terminates at the base portion, the base portion being wider than the narrow front end and being connected to an end of the wall of the tab-holding section, the narrow front end of the tab-holding member being accommodated between the inwardly curved ends of the opposing side members when the opposing side members are in a relaxed state, the base portion of the tab-holding member being accommodated between the curved ends of the opposing side members only when the opposing side members are forced outward under force imposed by the base portion of the tab-holding member as the tab is being forced rearward over the tab-holding member.

10. The system of claim 9, wherein the inwardly curved ends of the opposing side members are further characterized as terminating in substantially flat inner walls, each inner wall being disposed between a substantially square edge and a rounded edge, the rounded edge being disposed rearward and being arranged so that the rounded edge first engages the narrow front end of the tab-holding member as the tab is forced rearward over the tab-holding member, the square edge being disposed immediately rearward of the base portion of the tab-holding member when the tab is fully engaging the tab-holding member.

11. The system of claim 10, wherein the distal end of each finger obtaining a purchase on the rounded edge of the corresponding curved end of the tab.

12. The system of claim 11, wherein the tab is generally U-shaped, the front end including a slot disposed behind the front display wall, the slot accommodating the narrow front end to the tab-holding member, the slot also providing a stiff hinge-like connection between the two opposing side members of the tab.

13. The system of claim 12, wherein the tab-holding member is connected to the wall at a central portion of the base portion, the base portion being wider than the thickness of the wall thereby defining two steps on opposing sides of the wall.

14. A method of removing a size-indicating tab from a garment hanger equipped to accommodate size-indicating tabs, the method comprising:

closing a tab-removing tool around the size indicating tab mounted on the garment hanger, the tool comprising two opposing side members hingedly connected together, each member including at least one finger disposed at a distal end thereof, each finger is curved inwardly and includes a sharp, tapered distal end to assume a claw-like configuration, the distal end of each finger for obtaining a purchase on the tab, the hanger comprising a garment support member connected to a hang means, a tab-holding section disposed at the connection between the garment support member and the hang means, the tab-holding section comprising a wall having two opposing sides and connecting the tab-holding section to the hanger, the wall extending frontward toward the consumer and terminating at a slotted base portion of a tab-holding member, each side of the wall accommodating a slotted rib disposed between the slotted base portion of the tab-holding member and the hanger, each side of the wall further defining two receiving sections, one receiving section disposed between each slotted rib and the slotted base portion of the tab-holding member, the tab comprising two opposing side members with a front end disposed between the two opposing side members, the opposing side members extending rearward and terminating at inwardly curved ends, the tab engaging the tab-holding member so that the curved ends are in abutting engagement with the receiving sections;

clamping the tool inward causing the distal end of each finger to extend through the slotted rib, obtain a purchase on the curved end of the tab and extend at least partially into the slotted base portion of the tab-holding member;

pulling the tool and tab frontward and off the tab-holding member.

15. A system for labelling garment hangers to indicate the size of a garment hung on the garment hanger and for correcting mislabeled garment hangers, the system comprising:

a garment hanger;

a size-indicating tab; and a tool for removing the tab from the hanger;

the garment hanger including a tab-holding section, the tab-holding section comprising a wall having two opposing sides and connecting the tab-holding section to the hanger, the wall extending frontward toward the consumer and terminating at a base portion of a tab-holding member, each side of the wall accommodating an upward protrusion disposed between the base portion of the tab-holding member and the hanger, each side of the wall further defining two receiving sections, one receiving section disposed between each upward protrusion and the base portion of the tab-holding member, at least one channel extending through one upward protrusion, through one receiving section and through the base portion of the tab-holding member;

the tab comprising two opposing side members with a front end disposed between the two opposing side members, each opposing side member including an end, the tab engaging the tab-holding member so that the end of each opposing side member engages one of the receiving sections;

the tab removal tool including at least one finger disposed at a distal end thereof, the finger extending through the channel and obtaining a purchase on one end of the tab.

16. A method of removing a size-indicating tab from a garment hanger equipped to accommodate size-indicating tabs, the method comprising:

engaging a tab-removing tool with a size-indicating tab mounted on a garment hanger, the tool comprising two opposing side members hingedly connected together, at least one member including at least one finger disposed at a distal end thereof for obtaining purchase on the tab, the hanger comprising a tab-holding section, the tab-holding section comprising a wall having two opposing sides and connecting the tab-holding section to the hanger, the wall terminating at a base portion of a tab-holding member, each side of the wall accommodating a rib disposed between the base portion of the tab-holding member and the hanger, each side of the wall further defining two receiving sections, one receiving section disposed between each rib and the base portion of the tab-holding member, at least one channel extending through one rib, through one receiving section and through the base portion of the tab-holding member, the tab comprising two opposing side members with a front end disposed between the two opposing side members, each opposing side member extending rearward and terminating at an end, the tab engaging the tab-holding member so that the ends are in abutting engagement with the receiving sections;

applying pressure to the tool to cause the distal end of the finger to extend through the channel to obtain a purchase on one end of the tab;

moving the tool and tab off of the tab-holding member.

17. A system for labelling a garment hanger to indicate the size of a garment hung on the hanger and for correcting a mislabeled hanger, the system including a garment hanger, a size indicating tab, and tool means for removing the tab from the hanger, said hanger having a tab holding section, said tab holding section having a wall portion extending outwardly from the hanger, the wall portion terminating at a tab holder, rib means projecting outwardly from the wall portion, said rib means being spaced inwardly from the tab holder a distance (a) sufficient to enable the end portion of a tab placed on the tab holder to be received in the space between the outer portion of the rib means and the inner portion of the tab holder, but (b) insufficient to enable a finger to obtain a purchase on the end portion of a tab when the end portion of a tab is received in the space between the rib means and the tab holder, a channel in the rib means, said channel being sufficiently deep to enable a tab removing tool means to enter the channel and obtain a purchase on the end portion of a tab placed on the tab holder.

18. The system of claim 17 further characterized in that said tool means includes a finger shaped (a) to be received in the channel in the rib means and (b) to obtain a purchase on the end portion of a tab located in the space between the rib means and the tab holder.

19. The system of claim 17 further characterized in that firstly, the rib means includes a rib projecting outwardly from opposite sides of the wall portion, secondly, a channel is formed in each of said ribs, and thirdly, each of said channels is sufficiently deep to enable a tab removing tool means to enter each of the channels at the same time and obtain a purchase on the end portions of a tab placed on the tab holder.

20. The system of claim 19 further characterized in that said tool means includes a finger shaped (a) to be received in each of the rib channels on opposite sides of the wall portion and (b) to obtain a purchase on the end portion of a tab located in the space between the rib means and the tab holder on each side of the wall portion.

21. The system of claim 17 further characterized in that the channel in the rib means extends into the wall portion on the side of the rib means opposite the side on which the tab holder is disposed.

22. The system of claim 21 further characterized in that the channel in the rib means extends into the tab holder.

23. The system of claim 19 further characterized in that a plurality of channels are formed in each of said ribs, and said tool means includes a plurality of fingers shaped to be received in a plurality or rib channels on each side of the wall portion.

* * * * *